United States Patent [19]

Hornick

[11] 4,205,585

[45] Jun. 3, 1980

[54] AUDIO/VISUAL CONVERSION SYSTEM

[76] Inventor: Robert A. Hornick, 122-6919 Elbow Dr. SW., Calgary, Alberta, Canada

[21] Appl. No.: 781,720

[22] Filed: Mar. 28, 1977

[51] Int. Cl.[2] ..... A63J 17/00

[52] U.S. Cl. ..... 84/464 R; 181/163

[58] Field of Search ..... 84/464; 179/115 R; 181/161, 163, 166

[56] References Cited

U.S. PATENT DOCUMENTS

| | | | |
|---|---|---|---|
| 3,146,848 | 9/1964 | Fundingsland | 181/155 |
| 3,343,453 | 9/1967 | Butterfield | 84/464 |
| 3,590,681 | 7/1971 | Cross | 84/464 |
| 3,603,195 | 9/1971 | Williams | 84/464 |
| 3,858,305 | 1/1975 | Schenkel | 179/115 R |
| 4,050,541 | 9/1977 | Henricksen | 181/159 |

*Primary Examiner*—L. T. Hix
*Assistant Examiner*—S. D. Schneyer
*Attorney, Agent, or Firm*—Shlesinger, Arkwright, Garvey & Dinsmore

[57] ABSTRACT

This invention relates to an improved light display/projection system which synthesizes an infinite variety of pleasing geometrical patterns in response to electrical stimuli. When a hi-fidelity sound system is used to provide audio signals, the unit becomes suitable as a self-contained home or commercial entertainment device. Accordingly, the invention is described as an electrical signal to visual pattern conversion system comprising a housing, within which is operably assembled; at least one electromechanical transducer adapted to receive an audio frequency electrical input; at least one mechanical, pneumatic or electromagnetic or combination thereof coupling device for each transducer, coupling the transducer to at least one elastic membrane fixedly attached at its peripheral edge with a suitable clamp; at least one mirror attached parallel to the outer surface of the, or each, membrane and; at least one laser source positioned so as to direct light to the, or each, mirror. The housing containing the above components having at least one window consisting of a clear transparent material, or a screen of thin translucent material or a combination thereof. In operation, movement of the membrane(s) in response to electrical input cause the mirror(s) to deflect the incident light beam(s) producing a moving pattern of light that may be displayed on the screen or projected from the housing onto another surface.

11 Claims, 16 Drawing Figures

AUDIO/VISUAL CONVERSION SYSTEM

BACKGROUND OF THE INVENTION

The concept of providing a visual representation of sound while listening to music is an old one. In the past, various methods have been tried including the use of candles behind coloured glass that flashed light in step with the keys of an organ. Modern "colour organs" are electronic and add a decorative effect while listening to recordings, however, little detailed representation of significant interest occurs. A very accurate and precise display is viewed with an oscilloscope but this device lacks the enhancement that provides for an artistic or geometric presentation.

Historically, the French physicist Lissajous experimented with rubber bands and mirrors and produced some geometric shapes, now known as "lissajous figures". Recently, a device capable of projecting lissajous figures on a surface has been patented (Williams 1973, U.S. Pat. No. 3,603,195 ). The device is responsive to changes in audio input and creates images of an interesting and pleasing affect. A more detailed discussion of this prior art patent will be provided hereafter.

SUMMARY OF THE INVENTION

The invention relates to an improved light display/-projection system which synthesizes an infinite variety of pleasing geometrical patterns in response to electrical stimuli. When a hi-fidelity sound system is used to provide audio signals, the unit becomes suitable as a self-contained home or commercial entertainment device. Accordingly, the invention is described as an electrical signal to visual pattern conversion system comprising a housing, within which is operably assembled; at least one electromechanical transducer adapted to receive an audio frequency electrical input; at least one mechanical, pneumatic or electromagnetic or combination thereof coupling device for each transducer, coupling the transducer to at least one elastic membrane fixedly attached at its peripheral edge with a suitable clamp; at least one mirror attached parallel to the outer surface of the or each membrane and; at least one laser source positioned so as to direct light to the, or each, mirror. The housing containing the above components having at least one window consisting of a clear transparent material or a screen of thin material or a combination thereof. In operation, movement of the membrane(s) in response to electrical input causes the mirror(s) to deflect the incident light beam(s) producing a moving pattern of light that may be displayed on the screen or projected from the housing onto another surface.

DESCRIPTION OF THE DRAWINGS

The present invention will now be described by way of example only, reference being had to the accompanying drawings in which.

Figure 3:
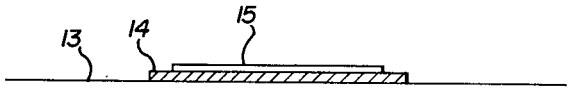
Figure 4:
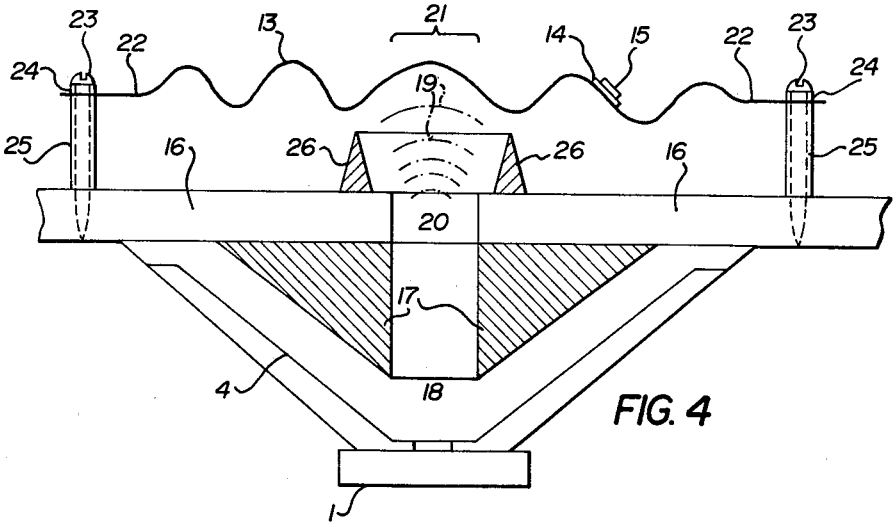
Figure 5:
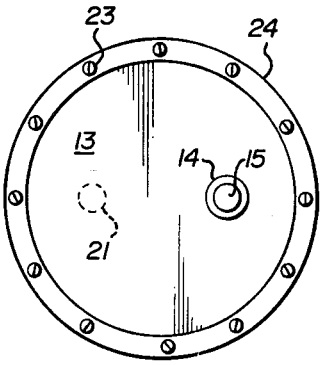
Figure 6:
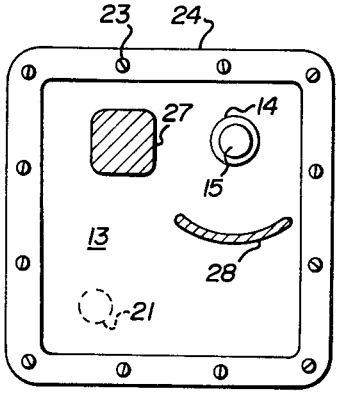
Figure 7:
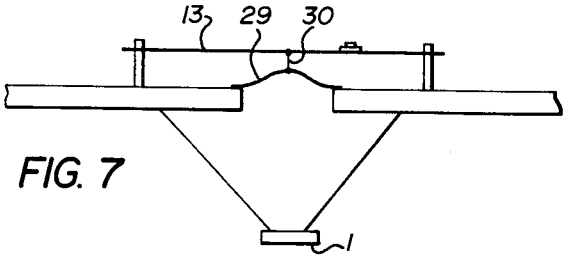
Figure 13:
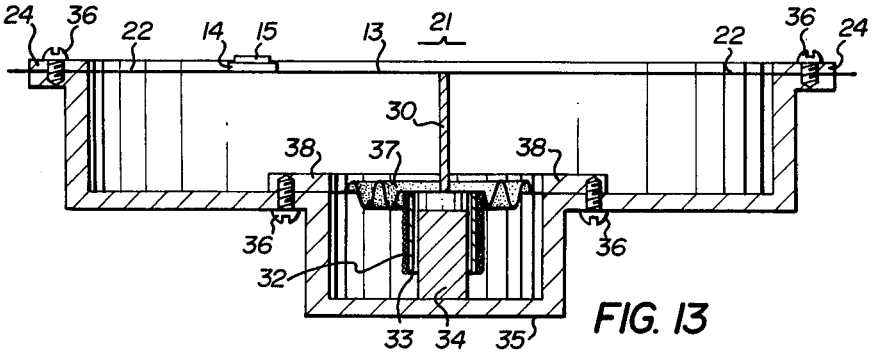
Figure 14:
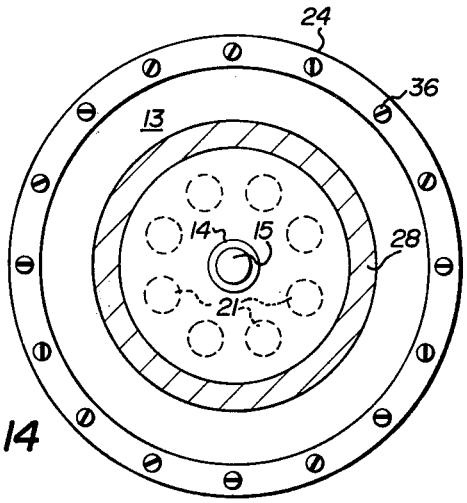
Figure 15:
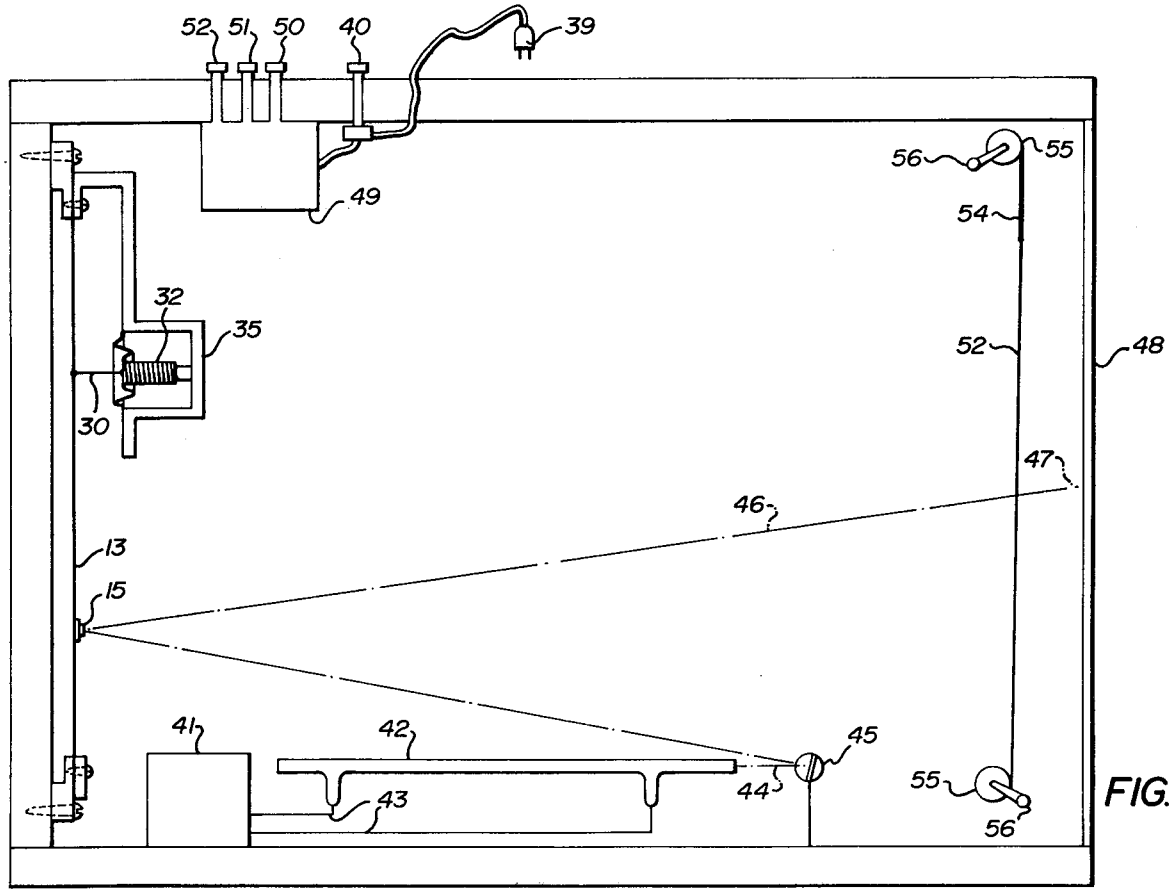

FIGS. *2a* and *2b* are illustrative of the manner in which a diaphragm or membrane moves in response to internal pressure changes;

FIG. 3 is a cross sectional view showing the membrane and attached mirror of the present invention;

FIG. 4 shows, in section, an arrangement which is in general terms the subject of Canadian Patent Application Ser. No. 265,350, filed Nov. 10, 1976, by the present Applicant whereby sound waves from a speaker are transmitted to a responsive membrane;

FIG. 5 is a general front view of the arrangement according to FIG. 4;

FIG. 6 shows an alternative configuration to that shown in FIG. 5, whereby stiffening means, applied to the membrane control energy and wave movement along the membrane surface;

FIG. 7 shows schematically, in section, one form of energy coupling arrangement utilizing a secondary membrane and mechanical coupling means;

FIGS. 8, 9, 10, 11 and 12 disclose various other energy coupling techniques utilizing magnetic energy to affect movement of the membrane;

FIG. 13 shows, in section, a preferred embodiment of the present invention, utilizing magnetic field energy coupling means;

FIG. 14 shows a front view of an arrangement similar to that shown in FIG. 13, but including a multiplicity of energization coils and associated damping means; and FIG. 15 is a diagramatic representation of a complete audio to visual conversion system according to the present invention.

BRIEF DISCUSSION OF PRIOR ART

Figure 1:
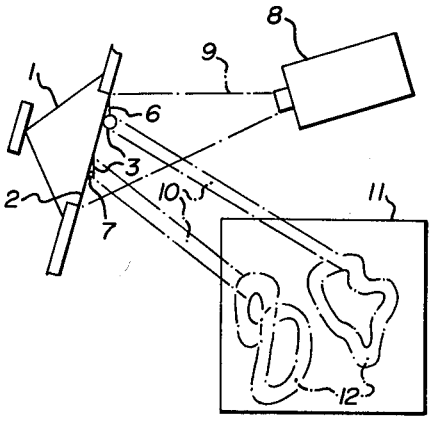
FIG. 1 (PRIOR ART)
FIG. 1 is a schematic representation of a prior art device, as disclosed in U.S. Pat. No. 3,603,195, Williams, issued Sept. 7, 1973 and entitled "MUSIC-RESPONSE LIGHT DISPLAY"
Figure 2A:
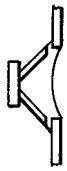
Figure 2B:
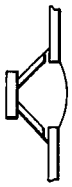

In construction, the prior art Williams device appears in FIG. 1. Basically, a common audio speaker (1) is covered with a thin elastic diaphragm (2) and mirrors dangle in front of the diaphragm (2). When a rarefaction is produced by the drawing of the speaker cone (4), as shown in an exemplary fashion in FIG. *2a*, a pressure drop is created in the airtight air chamber (5). External air pressure applies an external pressure and the diaphragm (2) assumes a concave shape. When the cone (4) moves forward creating a compression, the internal air pressure applies an even force and the diaphragm (2) assumes a convex shape as depicted by FIG. *2b*. The arrangement is forwardly inclined (FIG. 1) allowing the mirrors (3) to dangle freely from their strings (6), with the edge of the mirror just touching the diaphragm (2). Alternately, a mirror can be attached by means of a mount (7) that allows a portion of the mirror's edge to be in contact with the diaphragm (2). When an audio signal of sufficient power is fed to the speaker (1), the membrane (2) moves virtually synchronously with the movements of the speaker cone (4). These movements or vibrations of the diaphragm impart energy to the mirrors (3) whenever a collision between diaphragm (2) and mirror edge (3) occurs. This causes each mirror (3) to vibrate, gyrate and otherwise oscillate about itself. A light projector (8) projects a light beam (9) to the entire diaphragm surface (2). When this light is incident to a mirror (3), a reflected ray (10) is projected on the screen (11), and describes many different types of lissajous patterns (12). However, this overall design possesses several disadvantages for simplicity and practicality in home use.

Firstly, the transducing assembly must be set up at acritical slope to allow the diaphragm and mirrors to interact efficiently. Secondly, the edge of a mirror may rub or cut its way through the diaphragm rendering the internal air chamber not airtight. Thirdly, the equipment requires a large room area in which to operate effectively, involving (1) a projector, (ii) a transducing assembly, (iii) a suitable projection screen of high reflectivity. Fourthly, the room should be considerably darkened for good image resolution. Fifthly, the light projector must be focussed. Sixthly, by the very nature of the transducer, a great deal of distorted sound may emanate from the transducing assembly, interfering with the subjective enjoyment of listening to the sound from a modern hi-fidelity sound reproduction system. And seventhly, mirror damping is poor, meaning that optical response to the audio input is not necessarily as high as possible.

DESCRIPTION OF THE PREFERRED EMBODIMENTS

The seven weak areas disclosed above in reference to the prior art design have been significantly improved in the present invention, making the use of this class of electrical signal to visual pattern converter a practical and simple home and commercial entertainment instrument.

More specifically, the first, fourth, and seventh problems encountered with William's design can be easily cured by mounting the mirror(s) securely to the membrane surface, the mirror and the membrane being separated by a mount (14). FIG. 3 shows this configuration of elastic membrane (13), mount (14) and mirror (15). Since these three items are cemented securely together, mirror movement follows membrane movement precisely. A front surfaced mirror is preferable over a rear surfaced mirror. In the latter, reflection occurs at both the glass surface and mirrored surface causing double reflection, while a front surfaced mirror performs only one, clean reflection. With this arrangement, the transducing assembly is operable in, or at any attitude, the mount preventing contact of mirror edge to membrane surface thus avoiding friction between the two components. Thirdly, especially if the mirror and the mount are of little substantial mass, free mirror movements are nil, thus damping and response are high.

Of importance is the fact that in the prior art design, membrane movement is principally in and out and a mirror following this movement causes little beam deflection.

In contrast, with the present invention, there is movement in the membrane of a different nature, which can be more clearly understood by reference to FIGS. 4, 5 and 6, the subject matter of which will ultimately form part of a separate application, but is incorporated within this disclosure for reference purposes.

In FIG. 4, a ported baffle (16) covers most of the area between the speaker (1) and membrane (13). Air chamber fillers (17) displace out most of the air in the air chamber (18) causing higher energy compressions and rerefactions by the speaker cone (4). The speaker (1) is of a high compliance type capable of supplying high energy acoustic waves at low frequencies. Energy waves (19) are aimed, through the port (20) in baffle (16) to the membrane energization area (21). Here, concentrated acoustical energy meets the membrane (13) at a perpendicular angle causing a local distension of the member in the area of energization (21), thereby imparting energy to the membrane (13) which dissipates in wave fashion to the membrane perimeter (22), throughout the membrane. Energy limiting baffles (26) assist to confine the directed energy (19) to the energization area (21). If the energy limiting baffles (26) are sufficiently close to the membrane (13), secondary vibrations can be introduced in the membrane by driving the membrane with sufficient energy that it collides with the baffle (26).

The screw (23), clamp (24) and spacers (25) hold the membrane (13) in position. Although the membrane (13) can be glued in place, the illustrated method is preferred to allow for membrane replacement and membrane tension adjustment. If the clamp (24) and spacer (25) are chosen of a substantially firm material, a great deal of the dissipating energy along the membrane surface is reflected to meet with other waves travelling in different directions, causing the membrane (13) to undergo a repetitive series of distortions every second. For a given set of frequencies, as input with given intensities, the repetitive distortions are constant. Since the mirror is securely attached to the membrane, its attitude follows the membrane movements precisely. Because of the quickness of the distortion repetitions, a beam reflected from the mirror (15) appears solid in shape rather than as being perceived as a moving dot. The shape of the pattern changes in a precise and perceptually instantaneous fashion if either or both the audio frequencies or intensities change.

By varying the shape of the membrane perimeter, reflections occur in different directions resulting in different responses of the transducing assembly to a given frequency and intensity. FIGS. 5 and 6 show two different perimeter shapes. They may however be circular, oval, triangular, ellipsoid, square or even irregular in shape. FIG. 6 also shows a dampening patch (27) and dampening rib (28) on the membrane surface. These are made by applying a thickening agent, such as glue on areas of the membrane (13) with the purpose of influencing energy wave patterns. Different responses to audio input can be achieved by positioning the mirror (15) and energization area (21) in different locations on the membrane. Response is also affected by size and mass of mirrors, membrane thickness and material, and membrane area.

As a modification to the invention previously described in relation to FIGS. 3, 4 and 5, the present invention provides a more positive form of energy coupling between the source of audio energy and the responsive membrane, which increases the overall effect produced by the device.

As can be seen from FIG. 7, an intermediary or secondary elastic diaphragm (29) and mechanical coupler are used to focus the energization energy to a small area. The secondary membrane (29) is pneumatically coupled to the speaker (1) similar to the diaphragm in the prior art William's device; however the mechanical coupler (30) transfers energy from the intermediary diaphragm (29) to a very small area of energization (21) resulting in less overall membrane distension but more energy waves. This also considerably reduces the amount of sound that eminates from the transducing assembly, while still obtaining good light beam deflection.

Figure 8:
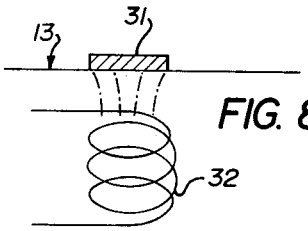
Figure 9:
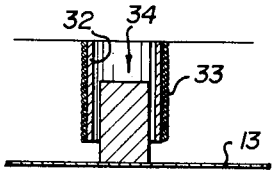
Figure 10:
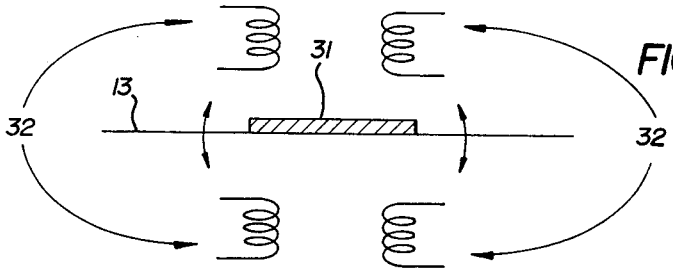

A simpler and more direct method of energy coupling without pneumatic coupling at all is to use a transducing method such as illustrated in FIG. 8. Here a disc or bar (31) is securely mounted onto the membrane (13). A nearby coil (32) directs an electromagnetic field from an audio signal source to the bar (31) inducing movement of the bar and consequently the membrane. FIG. 9 shows a variation with the coil (32) wrapped around the coil tube (33) and in which diameter the bar can fit. FIG. 10 shows a further modification in which four separate coils are used to cause a movement of a metallic member (31).

As will be appreciated, it is also possible to utilize a mechanical coupling directly between the transducer element and the membrane without requiring the inclusion of a secondary membrane as will be described in relation to FIG. 13.

Figure 11:
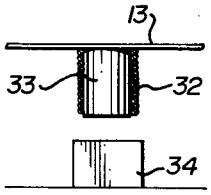
Figure 12:
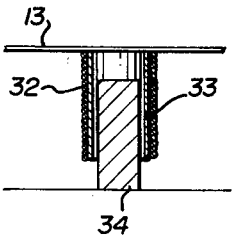

A more efficient method with better damping is shown in FIG. 11 and is achieved by reversing the positions of coil and member and putting the more lightweight coil (32) and coil tube (33) on the membrane. FIG. 12 shows the configuration of highest efficiency with a permanent magnet (34) in the center of the coil tube (33). The energization area is however considerably larger using this arrangement.

FIG. 13 illustrates a preferred embodiment of the invention and shows in section an electrical to mechanical transducing assembly. All the components of the assembly are mounted on the frame (25). The membrane (13) and membrane clamp (24) are held in position by bolts (26) threaded either into the frame (35) or into nuts on the opposite side of the frame (not shown). The coil tube (33) is centered about the permanent magnet (34) by the coil tube support (37) which allows free movement of the coil tube (33). The coil tube support is held in place by either glue or with a coil tube support clamp (38) and bolts (36). Energy is coupled from the coil tube (33) via the mechanical coupler (30) to the membrane at its place of attachment, that being the membrane energization area (21). The mirror mount (14) and mirror (15) are attached securely to the membrane (13).

Figure 14 shows a similar arrangement of parts as shown in FIG. 13. The perimeter shape is circular. There are however eight coils and eight associated energization areas (21). A circular rib (28) surrounding the energization areas (21) helps to dampen reflecting oscillations. The large diameter mirror (15), positioned in this example centrally of the membrane, is sensitive to a large area of membrane movement rather than to one small area, or in other words, is more sensitive to large distortions in the membrane than small ones. This type of an arrangement when appropriate control signals are present, is suitable for displaying arbitrary shapes since there is a high degree of membrane control.

The inadequacies of a film projector in providing a bright enough light beam and in the requirement of focussing in William's device are overcome with the use of a laser light source. When an appropriate laser source is used a very bright beam of small diameter and little divergence with distance can be had. Thus, the image can be easily seen in daylight and there is no need to focus the light beam. Since the beam is of small diameter (less than 0.2 cm), slight nuances in the shape of the image of less than 1.0 cm are easily observed. Any mirror size over 0.2 cm diameter can be used without any effect on the size of the displaying dot. Additionally, a laser is an efficient converter of energy producing little heat allowing all the major components, light source, electrical to mechanical transducing assembly, amplifier (if required) and display screen to be enclosed as a system in one enclosure thus simplifying operation.

In the system as heretofore described, the laser is directed towards the membrane and there is no necessity to alter, or change the direction of the light emmission from the laser. However the design of the overall system may be such that space does not permit the placement of the laser such that it can transmit light directly to the reflection device. In such a case therefore, it may be necessary to introduce one or more intermediate or "aiming" mirrors, which are angled so as to angle the path of the light beam until incident with the mirror.

A preferred embodiment of the present invention is illustrated in FIG. 15. Electrical power is supplied by plugging the AC plug (39) into a standard 110 v electrical outlet. Switch (40) turns power on and off. The laser power supply (41) supplies the proper operating voltage for the laser tube (42), via wires (43). The laser light beam (44) is aimed via a fixed, or gimbal mounted aiming mirror (45) to the deflection mirror (15), and the deflecting beam (46) produces a quickly moving dot (47) on the rear of the translucent display screen (48) which is easily observed by a viewer on the exterior. If the translucent screen (48) is removed, the unit becomes an always-in-focus projector of lissajous patterns. In this case a transparent pane of glass or plexiglass should be used to replace the translucent screen in order to protect the interior from dust and foreign objects. An alternative method is to have an internally stored translucent screen (52) just behind a transparent window (48) shown diagramatically in FIG. 15. The screen (52) has a portion of transparent plastic (53) and portion of translucent material (54) on rollers (55) which can be wound or unwound by rotating handle (56).

The amplifier (49) supplies operating power to the transducer coil (32). Input is through terminal (50). The size and response controls (51) and 52 respectively) alter the amplifying characteristics of the amplifier (49) to facilitate some degree of control over the final image size and the system's overall response to input signal.

Further modifications and alternative embodiments of the invention will be apparent to those skilled in the art in view of the foregoing description. Accordingly, this description is to be construed as illustrative only and is for the purpose of teaching those skilled in the art the manner of carrying out the invention. It is understood that the form of the invention shown and described is to be taken as the presently preferred embodiment. Various changes may be made in the shape, size and general arrangement of components. For example, equivalent elements may be substituted for those illustrated and described herein, parts may be reversed, and certain features of the invention may be used independently of the use of other features, all as will be apparent to one skilled in the art after having the benefits of the description of the invention.

What is claimed is:

1. An audio to video conversion system comprising a housing within which housing are operably assembled at least one electromechanical transducer adapted to receive an audio frequency electrical input and emit an energy signal directly related to said input; baffle means attached to said at least one transducer to impede energy output, said baffle means including a ported pneumatic energy transfer passage extending therethrough for facilitating initial concentration and directional control of energy output; a first elastic membrane fixedly mounted adjacent said transducer; a second elastic membrane fixedly attached to said baffle around the periphery of said passage so as to seal said passage; means mechanically coupling said second membrane to said first membrane; energy transfer means coupling said transducer output to said first membrane, such that the energy signal emission from said transducer is directionally controlled to impart energy to said first membrane at a predetermined, localized portion of said membrane; at least one reflection means mounted securely to said first membrane; and at least one laser source positioned so as to direct a narrow, high intensity light beam to said at least one reflection means.

2. The system according to claim 1 wherein said energy transfer passage is substantially less in its cross-secional area than said membrane.

3. The system according to claim 2 wherein said membrane includes stiffening means to provide a control of the damping characteristics thereof.

4. The system according to claim 3 including a plurality of reflection means, each of which accept light transmission from separate laser sources within said housing.

5. The system according to claim 4 wherein energy transmission to said secondary membrane is effected by electro-magnetic induction means.

6. The system according to claim 5 wherein said housing includes a translucent screen upon which the light reflected by said mirror is displayed.

7. The system according to claim 6 wherein said housing includes a suitable outlet through which light reflected by said reflection means is projected.

8. The system according to claim 1 wherein energy transmission to said first elastic membrane is effected by electro-magnetic induction means.

9. the system according to claim 1 wherein said reflection means comprise front faced mirrors.

10. The system according to claim 1 wherein said transducer and said elastic membrane are coupled mechanically.

11. The system according to claim 1 wherein amplifier means are included within said housing for operable association with said transducer.

* * * * *